US005927270A

United States Patent [19]

McDonald

[11] Patent Number: 5,927,270

[45] Date of Patent: Jul. 27, 1999

[54] GAS BURNER SYSTEM FOR FIREPLACES

[76] Inventor: Brian A McDonald, 7 Faulkland Road, Scarborough On, Canada, M1L 3S2

[21] Appl. No.: 08/826,970

[22] Filed: Apr. 9, 1997

[30] Foreign Application Priority Data

Apr. 15, 1996 [CA] Canada ..... 2174198

[51] Int. Cl.[6] ..... F24C 3/00

[52] U.S. Cl. ..... 126/512; 431/125; 126/92 R; 239/560; 239/556

[58] Field of Search ..... 126/512, 92 R, 126/41 R; 431/125, 286; 239/560, 556

[56] References Cited

U.S. PATENT DOCUMENTS

| | | | |
|---|---|---|---|
| 4,869,664 | 9/1989 | Wright et al. | 431/125 |
| 4,940,407 | 7/1990 | Rehberg et al. | 126/512 |
| 5,328,356 | 7/1994 | Hawkinson | 126/512 |
| 5,601,073 | 2/1997 | Shimek | 126/92 R |
| 5,671,727 | 9/1997 | Squires et al. | 431/125 |
| 5,722,824 | 3/1998 | Beck | 126/92 R |

*Primary Examiner*—Ira S. Lazarus

[57] ABSTRACT

A gas burner for gas fireplaces has a housing defining a shallow chamber with an extended top and surface which covers most of the grate area of a gas fireplace and supports non-combustible logs and embers. The chamber has an opening receiving gas or a mixture of gas and primary air, which is discharged through areas of perforations formed in a top wall of the chamber, these areas including both relatively broader and relatively narrower and elongated areas irregularly distributed and oriented over the top wall to provide flames between the logs and to render the embers incandescent, with the areas connected or adjacent to promote the spread of flame between them during ignition. The top wall may be formed by laminating two metal sheets, one perforated and the other formed with slots and holes defining the perforated areas.

8 Claims, 3 Drawing Sheets

GAS BURNER SYSTEM FOR FIREPLACES

FIELD OF THE INVENTION

This invention relates to gas burner systems for gas fireplaces. It more particularly relates to gas burner systems utilizing a pan or tray type of burner assembly for use with non-combustible fire logs and/or non-combustible embers.

BACKGROUND OF THE INVENTION

Gas fireplaces of the type that simulate natural wood fires are well known. There are many different types and many different designs of these gas fireplaces, for example, "gas logs" and "gas inserts" are gas fireplace products which are designed to be installed into existing wood-burning fireplaces to convert them into gas fireplaces. Other types of gas fireplace products include "free-standing gas fireplaces", "wall mounting gas fireplaces" and "zero-clearance gas fireplaces". Such gas fireplaces may be conventionally vented, power-vented, direct vented or unvented. All of these gas fireplaces use some type of gas burner to produce the flames in conjunction with an arrangement of non-combustible fire logs and often non-combustible embers to simulate a natural wood fire.

However, most of these burner systems provide only a poor simulation of a natural wood fire. This is due in part to regional and national product approval standards that govern the manufacture and sale of gas fireplace products. In particular, most gas fireplaces are required to produce relatively low levels of carbon monoxide unlike their wood fireplace counterparts which are unrestricted in the amount of carbon monoxide that they can produce. The appearance of the fire itself is a very important factor in the saleability of a particular gas fireplace. Accordingly, many gas fireplace manufacturers, designers and inventors continue to develop new and improved methods and apparatus for making a gas fire that more closely resembles a natural wood fire and also meets or exceeds the required product approval standards.

One type of burner system that has enjoyed good sales and wide acceptance for producing an appealing gas fire is a type of pan burner referred to as a "sand-pan burner". This type of burner is very common and usually consists of a light gauge sheet metal pan with vertically inclined walls that house a gas supply tube with holes that are usually directed downward towards a non-combustible granular material such as silica sand or vermiculite placed in the pan to cover the tube. During operation gas percolates through the voids of this material and ignites when it reaches the surface in the presence of a flame. This pan is placed on the firebox floor with non-combustible fire logs supported above it usually on some type of a fireplace grate. In effect, some of the openings between the granules on the top surface of the non-combustible material became the burner gas ports. A problem with this type of burner is that it generally requires a larger volume of gas per hour to produce an attractive fire which precludes its uses in many enclosed type gas fireplace products where the combustion requirements are more limited. In addition, since the gas ports are not well defined and may in fact vary considerably, good flame control is difficult resulting in undesired flame contact with portions of the metal grate or non-combustible logs increasing the production of carbon monoxide.

More recent pan or tray type burners are disclosed in U.S. Pat. Nos 5,328,326 and 5,399,084. These burner designs have a metal top wall enclosing the pan with internal components to direct or restrict the flow of gas within the burner, with numerous gas ports punched or drilled in long rows along the front and rear edges of the burner with provisions for placing a long front log between these front and rear rows of gas ports generally covering the entire central area of the burner. Additional gas ports linking front and rear rows of ports run parallel to the side walls of the burner. These pan burners clearly define the location of each gas port and the resulting flames offer reproducible results that can meet product approval requirements. While there is the capability of increasing flame height and width the resulting flames are in straight lines along the outer edges of the burner resulting in fire that looks very linear and orderly and consequently a fire that does not closely resemble a natural wood fire.

SUMMARY OF THE INVENTION

It is the primary object of the invention to provide a method of constructing a gas burner that has the capability to selectively position gas ports anywhere over the top surface of the burner that substantially covers the entire base area of a typical fireplace grate allowing flames to appear in an asymmetrical and random fashion easily adapted to virtually any arrangement of non-combustible fire logs and non-combustible ember pieces positioned above the burner.

It is another object of the invention to provide a simple method of constructing a gas burner with numerous burner gas ports capable of producing a random flame appearance with flames; of different height, width, depth, orientation and positioning without special tooling and with a minimum of hole punching or drilling and which can also be altered to produce substantially different flame patterns simply by substituting a single metal panel.

It is another object of the invention to provide a gas burner without internal baffling capable of producing a spread out flame pattern with a relatively low gas input.

It is another object of the invention to provide a gas burner that allows individual flames to have the attribute of depth in addition to height and width attributes so that when the flames are viewed sideways they do not have the same general depth or thickness, in contrast to prior art gas burners gas burners which generally produce thin gas flames of similar size.

It is another object of the invention to add visual depth to the fire so that when it is viewed from the side not only do the individual flames have depth but the overall fire has greater depth, in contrast to prior art gas burners where the fire is in one or two thin, straight rows of flames.

It is another object of the invention to provide a low gas consumption method of flame layout that takes full advantage of the width and depth of a pan or tray type burner by using shorter diagonal lines of gas ports within the central portion of the burner area to connect with outlying flames instead of aligning the majority of gas ports along the periphery of the burner.

It is a further object of the invention to maximize the amount of visible flame for any given amount of flame being generated by eliminating the larger front log that typically makes up part of the non-combustible log arrangement of prior art gas fireplaces which hides from sight the bases of most rear flames and virtually all of the carryover flames between rear flames and replace this larger front log with smaller front logs that have spaces beneath and between each other with a corresponding gas arrangement allowing greater visibility of rear flames.

Accordingly, the invention provides a gas burner according to claim 12, wherein the top wall of the plenum chamber is formed by a sheet of perforated metal laminated to a sheet formed with openings and slots defining said areas. Further aspects of the invention will be apparent from the following description and appended claims.

DETAILED DESCRIPTION OF THE PREFERRED EMBODIMENTS

Figure 1:
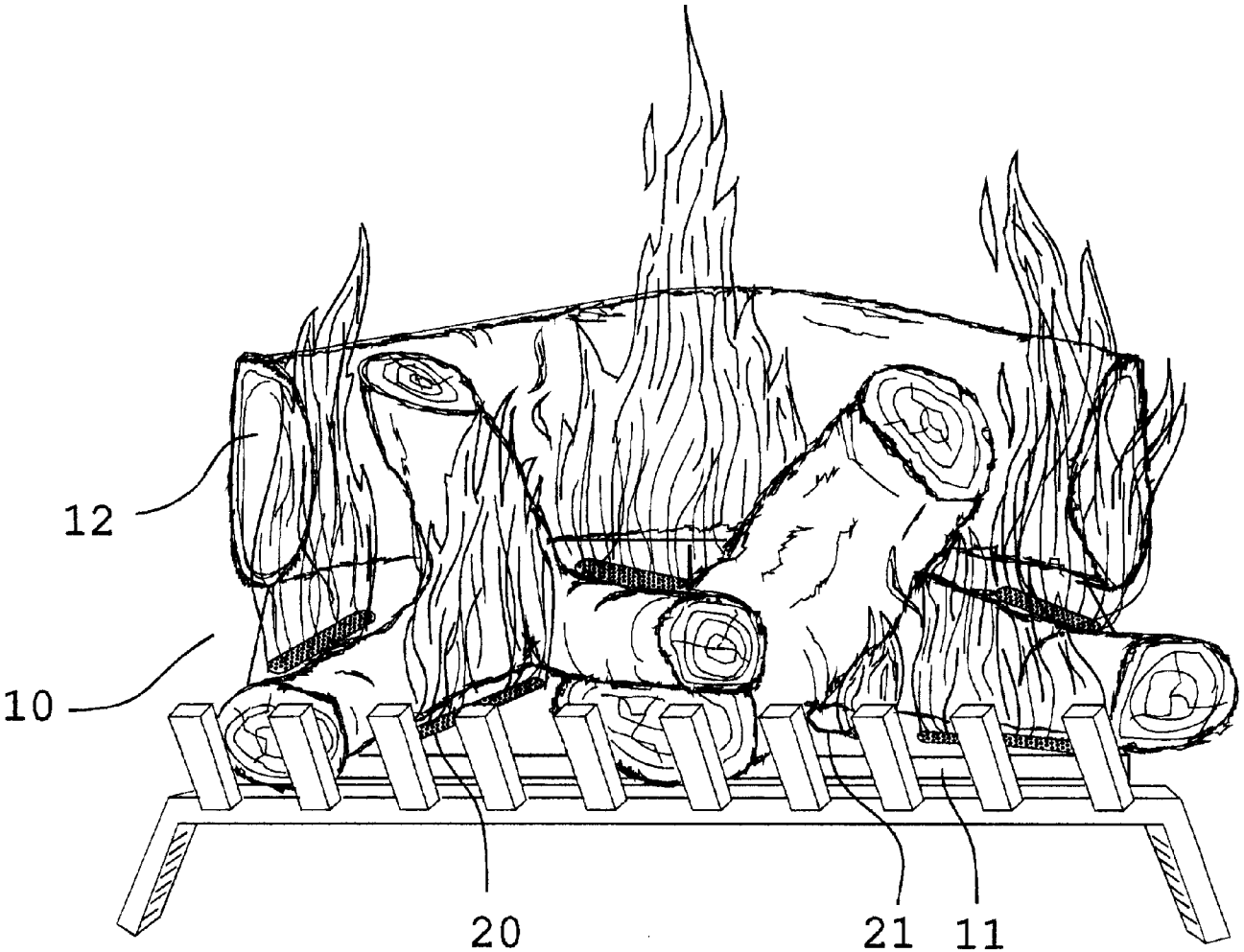
FIG. 1 is a front elevation of a preferred embodiment of a gas fireplace incorporating a burner system in accordance with the invention.

Referring now to the drawings and particularly FIG. 1, there is shown a gas burner system 10 including pan burner 11 and non-combustible fire logs 12.

Figure 2:
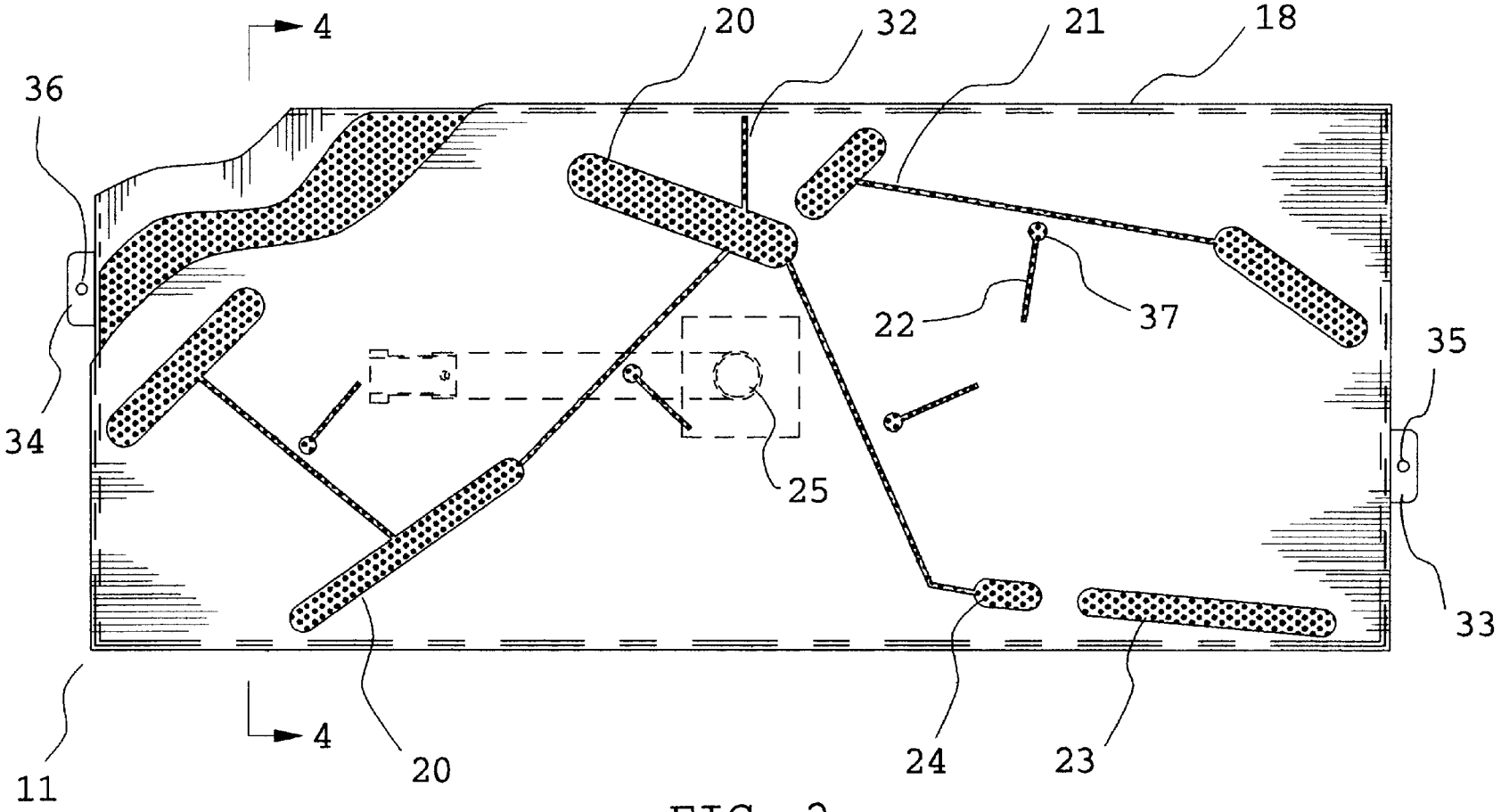
FIG. 2 is a top plan view of the gas burner, partially broken away to show its internal construction.
Figure 3:
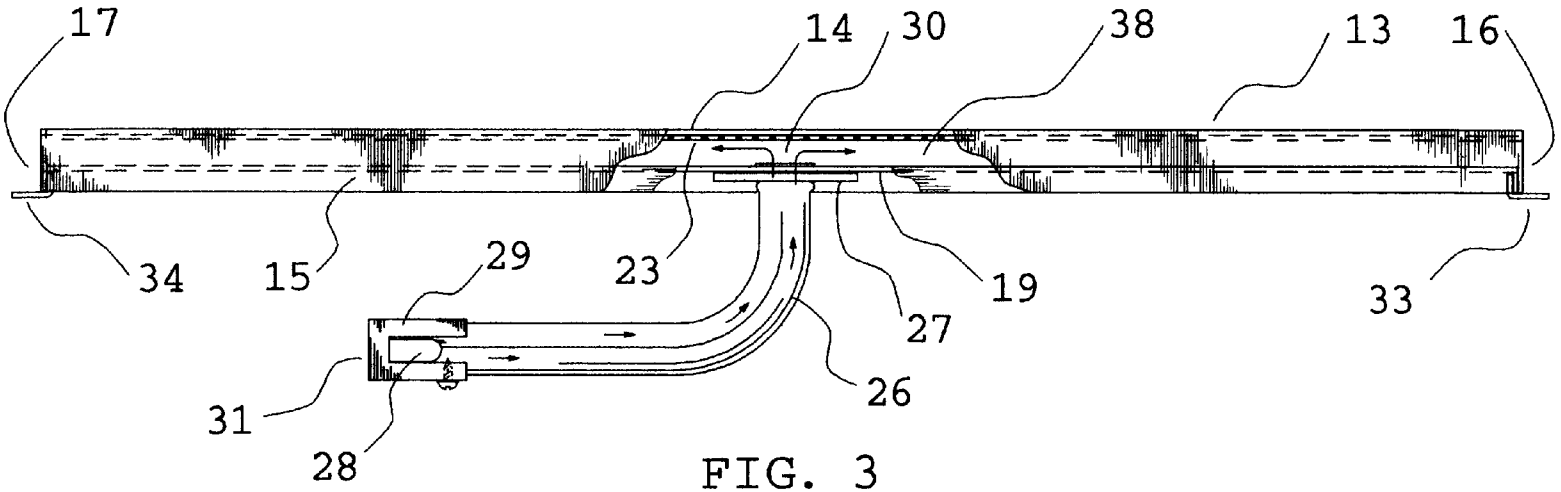
FIG. 3 is a front elevation of the gas burner, partially broken away to show its internal construction.
Figure 4:
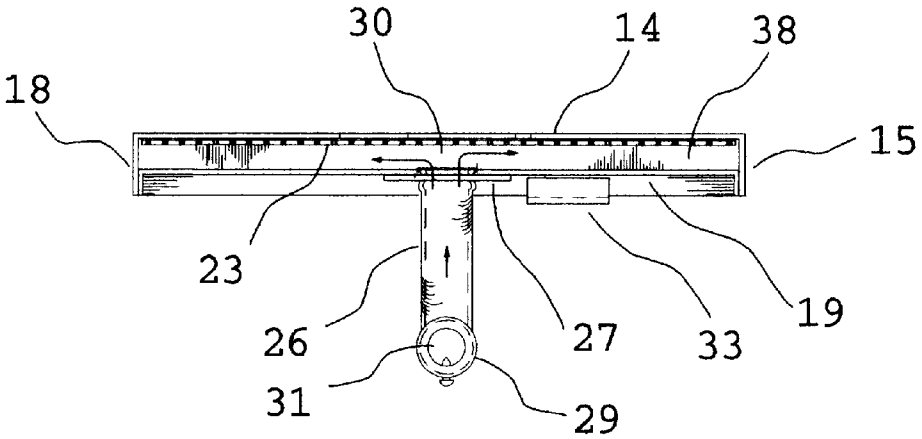
FIG. 4 is a cross-sectional view along the lines 4—4 of FIG. 2.

Referring to FIGS. 2, 3 and 4 the burner pan 11 comprises a top section 13 and a bottom section 19 made of sheet metal of the type suitable for use as a burner and in accordance with applicable regulations. Top section 13 and bottom section 19 are assembled together in a gas tight manner, such as by welding, with the interior wall surfaces defining a shallow enclosed chamber forming burner plenum 38, to direct the gas fuel mixture from a gas fuel mixture supply conduit 26 to all burner ports 24. Top section 13 has a top wall 14, a front wall 15, side walls 16 and 17, and rear wall 18. The top wall 14 defines an arrangement of larger holes 20 which may vary in size, shape and orientation and may be located at any point on top wall 14 with narrow slots 21 providing linkage between these larger holes, except when they are in close proximity. In addition, top wall 14 has keyhole like slots 22 formed by smaller circular holes 37 with a short narrow slot forming tails extending from the circles. These keyhole like slots 22 have their holes 37 adjacent certain of the narrow slots 21 with their tails generally at right angles to the narrow slots 21. A layer 23, of perforated sheet metal stock, with a flat surface and small closely spaced holes 24, is secured tightly to the underside of top wall 14, by spot welding for example, so that there is essentially no air space between the top surface of lower layer 23 and the bottom surface of top wall 14. Thus the small closely spaced holes 24 of lower layer 23 or the portions thereof, directly beneath larger holes 20, the narrow slots 21, and keyhole slots 22, are operative to act as the burner ports. In an alternative arrangement (not shown) the perforated layer 23 overlies the top wall 14.

It is a preferred feature of this invention regarding that use is made of perforated metal with a flat surface defining small closely spaced holes for the lower layer which is to be secured tightly to the bottom surface of top wall 14. The holes are such as to result in directional jets of emerging gas. Wire mesh, gauze screens and similar materials often used around tubular burners are less desirable because these materials allow gas flow in a horizontal plane between their strands and into larger holes 20, and narrow slots 21, and keyhole slots 22 in addition to the vertical gas flow, effectively diffusing the flow and making the larger holes 20, narrow slots 21, and keyhole slots 22 into oversized gas burner ports, which greatly reduces control over flame size and the gas flow rate characteristics of the burner. Perforated metal with a flat surface defining small closely spaced holes does not allow horizontal gas flow between its rows of holes and only allows gas to flow vertically through the holes, or portions thereof, directly beneath larger holes 20, narrow slots 21, and keyhole slots 22.

The bottom wall 19 defines a gas supply aperture 25 centrally located with the gas fuel mixture supply conduit 26 secured in a gas tight manner to the underside of bottom wall 19. Gas fuel mixture supply conduit 26 is of tubular construction formed with a 90 degree bend and with a flange 27 at the outlet opening 30 to facilitate its attachment to bottom wall 19. The inlet end of gas fuel mixture supply conduit 26 has a primary air opening 28 which extends a short distance along the length of gas fuel mixture supply conduit 26 with a primary air shutter 29 of cylindrical construction sized to fit over gas fuel mixture supply conduit 26 with provisions to adjustable close off primary air opening 28 as a means of controlling the amount of primary air to be mixed with the supply gas. A burner orifice, not shown, provides gas flow control means and fits into inlet opening 31. Although the described embodiment utilizes a gas/air mixture in which primary air has been added to the gas, the invention is also applicable to burners utilizing neat gas, with combustion air being provided solely by a secondary air supply external to the burner. The term "gaseous fuel" is used herein to encompass gas/air mixtures and neat gas.

Mounting brackets 33 and 34 are secured to side walls 16 and 17 and have mounting holes 35 and 36 to secure burner 11 in position in a fireplace (see FIG. 1).

It will be appreciated that the burner port layout resulting from the arrangement of larger holes 20, narrow slots 21, and keyhole slots 22 produces flames of various sizes. Larger holes 20, produce higher flames, and narrow slots 21 and keyhole slots 22 produce lower flames. Generally, the width of larger holes 20 controls the flame height, and the length of larger holes 20 control flame width. It is a secondary function of narrow slots 21 to provide interconnection to the higher flames produced by larger holes 20 to ensure flame carryover to all ports from one ignition point. Narrow slot 32 extends from a larger hole 20 to the rear edge of top wall 14 to an ignition source, not shown, mounted close to the outer edge of burner 11.

It will also be appreciated that the flames of a natural wood burning fire do not occur in neat, parallel rows as it is customarily the case with prior art gas fires. It is a preferred feature of the present invention that the larger holes 20 are positioned in an irregularly distributed arrangement in the top wall 14 of burner top section 13. Larger holes 20 may be placed at any position on top wall 14 but are selectively positioned to reflect the overall appearance of the fire desired and consistent with the size, shape and positioning of the non-combustible fire logs 12. Larger holes 20 are generally oriented in different angles with respect to each other and not parallel to the outer edges of burner 11 in order to give the flame pattern a more random appearance. In addition to flame randomness, this method of orienting larger holes 20 has the effect of adding increased flame depth to each individual flame unlike prior art gas burners where higher flames viewed from a side view are uniformly thin, a result of the few rows of gas ports being oriented parallel to the front edge of the prior art burners. With the present invention, the flames should provide a more natural appearance when viewed from any angle.

While larger holes 20 are generally spread out to take full advantage of the size of top wall 14 so as to create the appearance of a large fire by having higher flames centrally and at the outer ends as well as higher flames at the rear and front sections of the burner, larger holes 20 are also strategically positioned in relation to each other with respect to the depth of top wall 14, so that when viewed from the side, higher flames overlap each other providing flame coverage across the depth of top wall 14 adding greatly to the realistic appearance of the fire. This is in sharp contrast to prior art gas burners when viewed from the side where higher flames are confined to one or two easily distinguishable, thin rows of flames.

Referring to FIG. 2, it can be seen that narrow slots 21 provide linkage to all larger holes 20 and keyhole slots 22 and that narrow slots 21 are not parallel to the outer edges of burner 11 as it is customary with most prior art gas burners. In sharp contrast, narrow slots 21 are placed in the interior section of top wall 14 oriented at different angles with respect to each other and not parallel with the outer edges of burner 11, complimenting and enhancing the random appearance of the higher flames produced by larger holes 20.

There is a high degree of flexibility in positioning narrow slots 21 to interconnect larger holes 20, as narrow slots 21 can originate from any point along the edge of any larger hole 20 and connect to any point along the edge of an adjacent larger hole 20. This allows for the lower flames produced by narrow slots 21 to be placed where they will not cause undesirable flame impingement on certain non-combustible fire logs placed near larger holes 20 thereby improving the combustion performance of the gas fire. In addition, it generally allows for the advantageous placement of the lower flames to both minimize fuel consumption by limiting the distance required to ensure ignition to all gas ports, and provide greater visibility of the lower flames and glowing embers enhancing the overall appearance of the gas fire. The appearance of lower flames and glowing embers is further enhanced by the use of keyhole slots 22. Non-combustible ember pieces of low thermal inertia are placed over narrow slots 21 so as to incandesce and produce a glowing ember effect, while dispersing the lower flames laterally and irregularly, somewhat disguising the linearity of the lower flames. Keyhole slots 22 are used specifically to improve the appearance of the lower flames and glowing embers associated with narrow slots 21. Keyhole slots 22 are selectively positioned in highly visible areas along the length of certain narrow slots 21 and are oriented generally at right angles to a particular narrow slot 21 so that the width of lower flames and associated glowing embers is significantly increased along a particular narrow slot 21. Since the fire is not viewed from the top but from a forward vantage point, it can be appreciated that a single line of lower flames and glowing embers branching off from the lower flames and glowing embers produced from a narrow slot 21 has the effect of transforming a thin line of flames and glowing embers into the appearance of an area rather than a line. Thus a narrow row of lower flames and glowing embers appears to change to a much wider area of lower flames and glowing embers and then back to a narrow row of lower flames and glowing embers. The resulting effect of is to transform a line of flames and glowing embers into a pocket of glowing embers and flame such as is characteristic of natural wood burning fires. The circular holes 37 associated with keyhole slots 22 are operative to produce a slightly larger flame to ensure that ignition is carried from narrow slot 21 over to keyhole slot 22 in instances when the random placement of noncombustible ember pieces over burner ports of a narrow slot 21 immediately opposite a keyhole slot 22, might direct the flames away from the keyhole slot. The additional flow of gas out of circular hole 37 is sufficient to carry ignition from neighbouring burner ports of adjacent narrow slot 21.

The quantity of flames and glowing embers visible from a typical viewing position, such as from a seated position somewhere in front or to the side of the fire, is preferably increased by eliminating the customary larger non-combustible front fire log that runs parallel to the front of the fireplace and gas burner in most prior art gas fire arrangements, and replacing it with smaller logs positioned in a more random arrangement. The large front log that is used with prior art gas burners hides from sight the bases of most rear flames and virtually all the carryover flames connecting other higher rear flames when viewed from a typical view point, but has been needed to help conceal the artificial nature of the fire. In one embodiment of the invention, a preferred log arrangement, to accompany the more random placement of higher flames, lower flames and glowing embers produced from burner 11, comprises a a large rear non-combustible fire log above and parallel to rear wall 18, with smaller non-combustible front fire logs positioned above top wall 14 and in front of said large rear firelog with said smaller front firelogs oriented in different directions and inclinations with respect to each other so that spaces exist beneath and between said smaller front firelogs allowing for flames and glowing embers to bee seen therein as well as greater visibility of flames and glowing embers above the central and rear portions of top wall 14. The resulting gas fire appears to have a random arrangement of higher flames, lower flames and glowing embers emanating from most areas of the log arrangement that is also random in appearance and complimentary to the flame arrangement. Flames are visible in forward, central and rearward locations with pockets of glowing embers visible beside and beneath the smaller front fire logs providing openings to view flames and glowing embers from the most forward position to the most rearward position, accentuating the depth of the fire, an important characteristic of natural wood burning fires that is only modestly exhibited in prior art gas burners. The following distinctions may be made from prior art gas burners with respect to the improved methods of providing visual depth to a gas fire outlined herein. With respect to sand-pan burners where flames and glowing embers can be seen with some aspect of depth to them, this is only true from beneath the grate, inches below the non-combustible fire logs. It is however uncharacteristic of natural wood-burning fires to have all the flames and glowing embers originating from beneath the grate and instead of around the fire logs themselves and this significantly detracts from the realism of this type of gas fire. In addition, the large front firelogs block any intermediate view of the central and rearward flames, reducing the apparent depth of the fire. Similarly, there is distinction from gas burner systems such as those using a front log with the lower, centre section cut-away to increase visibility of a single, centrally confined, bed of glowing embers that leads back to a centrally located rear flame. While an aspect of depth to lower flames and glowing embers is present in this design, the necessary cut-away of the center section of the front log greatly detracts from its realism along with the single continuous bed of glowing embers which does not closely resemble natural wood burning fires.

Referring to FIG. 1, positioning and securing of non-combustible fire logs 12, into a fixed relationship with the burner 11, can be effected by locating pins (not shown) secured to top wall 14. Non-combustible fire logs 12 have corresponding holes to fit over locating pins. Alternatively, locating pins, guides or other locating means can be secured to the fireplace grate assembly which can also be used to locate burner 11, which will normally occupy most if not all of the grate area.

Referring to FIGS. 3 and 4, a jet of gas discharging during operation from the burner orifice, not shown, into the gas fuel mixture supply conduit 26 creates a low pressure zone inside at primary air opening 28 causing air to flow into gas fuel mixture supply conduit 26 and to be entrained and mixed with the flow of gas through gas fuel mixture supply conduit 26. The adjustment of air shutter 29 to increase or reduce the opening area of opening 28 causes a corresponding increase or decrease in the amount of air being introduced into the gas fuel mixture. Gas/fuel mixture flowing vertically from outlet 30 of gas fuel mixture supply conduit 26 is redirected by top wall 14 horizontally and radially throughout gas burner plenum 38. Gas burner ports 23 have the combined opening area and flow rate characteristics to ensure the gas burner plenum 38 is sufficiently pressurized, even at a minimum flow rate setting, for gas/fuel mixture to flow outwardly through all gas burner ports. Gas flowing out of narrow slot 32 is ignited by a pilot flame, not shown, whence ignition is carried to all larger holes 20, and keyhole slots 22 by the narrow slots 21. If it is necessary to place a hole or slot immediately above the outlet 30, a diffusion plate (not shown) should be located above the outlet 30 to deflect the mixture outwardly so that it does not impinge directly on the hole or slot.

While various preferred embodiments of the present invention have been described herein, it will be understood by those skilled in the art, that variations may be made thereto without departing from the spirit of the invention or the scope of the appended claims.

The embodiments of the invention in which an exclusive property or privilege is claimed are defined as follows:

1. A gas burner for gas fireplaces comprising:

a formed metal assembly including a top wall, a bottom wall, a front wall, a rear wall, and side walls joined in a gas tight manner with the inner surfaces of said walls defining an enclosed chamber free of internal obstructions, and which is shallow compared to linear dimensions of the top wall;

said top wall being of a lamination of two layers of metal, one layer of said top wall defining, distributed over its area, an arrangement of larger holes which may vary in size and shape and may be located at any point on said one layer with narrow slots providing linkage to said larger holes, and the other layer being of perforated sheet metal stock with a flat surface defining small closely spaced holes, which is secured in contact with the underside of said one layer so that there is no air space between adjacent surfaces of said one layer and the other layer, whereby the small closely spaced holes of said one layer, or portions thereof, coincident with said larger holes and said narrow slots in said other layer form gas outlet ports to allow gas fuel mixture to flow outwardly from said enclosed chamber for combustion to form flames;

said larger holes being operative to produce relatively higher flames, and said narrow slots being operative to produce relatively lower flames and provide flame carry over to all gas ports from a single ignition point;

said bottom wall defining a gas supply aperture whereby gas fuel mixture flows into said shallow enclosed chamber in a vertical direction and is redirected horizontally and radially by said top wall throughout said shallow enclosed chamber pressurizing the entire said shallow enclosed chamber and causing gas fuel mixture to flow outwardly through all said gas outlet ports;

said gas outlet ports having the combined opening area and flow rate characteristics to ensure said shallow enclosed chamber is sufficiently pressurized under the minimum gas fuel mixture supply flow rate setting to ensure gas fuel mixture is directed outwardly from each gas outlet port; and a gas fuel mixture supply conduit secured in a gas tight manner to said gas supply aperture in said bottom wall so that said gas fuel mixture supply conduit is in free communication with said shallow enclosed chamber said conduit including means for admixing primary combustion air.

2. The gas burner of claim 1, wherein said larger holes on said top wall are elongated slots assorted in size, shape and orientation.

3. The gas burner of claim 2, wherein said wider slots and narrow slots of said top wall, are mostly oriented in different directions from each other and are mostly not parallel with said front, rear and side walls.

4. The gas burner of claim 3, wherein non-combustible fire logs and non-combustible ember pieces are disposed on said top wall in suitable relation to said gas outlet ports on said top wall such as to simulate a natural wood fire with pockets of glowing embers between the logs during burner operation.

5. The gas burner of claim 4, wherein additional narrow slots for the purpose of increasing the size of a pocket of glowing embers are placed in the top wall with at least one end of each said additional narrow slot adjacent said wider slots or said narrow slots to ensure flame carry over.

6. The gas burner of claim 4, wherein said non-combustible fire logs comprise a large rear firelog positioned above and parallel to said rear wall, with smaller non-combustible front fire logs positioned above said top wall and in front of said large rear firelog with said smaller front firelogs oriented in different directions and inclinations each with respect to each other so that spaces exist beneath and between said smaller front firelogs framing flames and glowing embers therein and providing greater visibility from in front of flames and glowing embers above central and rear portions of said top wall.

7. The gas burner of claim 1, wherein the one layer of the top wall is above the other layer.

8. A gas burner for a gas fireplace, of the type comprising walls defining a plenum chamber having an opening thereinto for the admission of gaseous fuel, and areas of perforations forming gas burner ports defined in a top wall of the chamber, said top wall of said plenum chamber being formed by a sheet of perforated metal laminated to a sheet formed with openings and slots defining said areas, the areas including relatively broader areas producing relatively higher flames and relatively narrower and elongated areas producing relatively lower flames, the areas being connected or adjacent to promote the spread of flames herebetween; wherein the improvement comprises forming the plenum chamber with a substantially horizontal top surface having a width and depth such as to extend over most of the grate area of the fireplace, and a depth which is small compared to the width and depth of the top surface, and distributing said areas of perforations over the width and depth of said top surface in an irregular pattern providing paths over said top surface from margins thereof to said perforations for combustion air.

* * * * *